US006698975B1

(12) United States Patent
Benecke

(10) Patent No.: US 6,698,975 B1
(45) Date of Patent: Mar. 2, 2004

(54) COUPLING STRUCTURE FOR A LEACHING CHAMBER

(75) Inventor: Arnold G. Benecke, Wharton, OH (US)

(73) Assignee: Hancor, Inc., Findlay, OH (US)

( * ) Notice: Subject to any disclaimer, the term of this patent is extended or adjusted under 35 U.S.C. 154(b) by 0 days.

(21) Appl. No.: 10/228,852

(22) Filed: Aug. 27, 2002

(51) Int. Cl.[7] ..... E02B 13/00
(52) U.S. Cl. ..... 405/43; 405/46; 405/49
(58) Field of Search ..... 405/36, 43, 44, 405/45, 46, 47, 48, 49, 51, 124–126; 285/284.1

(56) References Cited

U.S. PATENT DOCUMENTS

| | | | | |
|---|---|---|---|---|
| 2,153,789 | A | 4/1939 | Carswell et al. | |
| 2,366,522 | A | 1/1945 | Gutman | |
| 4,192,628 | A | 3/1980 | Gorman | |
| 4,305,683 | A | 12/1981 | Wagner et al. | |
| 4,360,042 | A | 11/1982 | Fouss et al. | |
| 4,753,661 | A | 6/1988 | Nelson et al. | |
| 4,759,661 | A | 7/1988 | Nichols et al. | |
| 5,017,041 | A | 5/1991 | Nichols | |
| 5,087,151 | A | 2/1992 | DiTullio | |
| D329,684 | S | 9/1992 | Gray | |
| 5,156,488 | A | 10/1992 | Nichols | |
| 5,336,017 | A | 8/1994 | Nichols | |
| 5,401,116 | A | 3/1995 | Nichols | |
| 5,441,363 | A | 8/1995 | Gray | |
| 5,511,903 | A | 4/1996 | Nichols et al. | |
| 5,556,231 | A | 9/1996 | Sidaway et al. | 405/48 |
| 5,588,778 | A | 12/1996 | Nichols et al. | |
| 6,076,993 | A | 6/2000 | Gray | |
| 6,270,287 | B1 | 8/2001 | Gray | 405/100 |

OTHER PUBLICATIONS

Undated drawing in Applicant's possession of a prior art leaching chamber.

*Primary Examiner*—Thomas B. Will
*Assistant Examiner*—Tara L. Mayo
(74) *Attorney, Agent, or Firm*—Jones Day

(57) ABSTRACT

A leaching chamber is configured to be coupled in series to another such leaching chamber located forward of the chamber and to yet another such leaching chamber located rearward of said leaching chamber. The leaching chamber comprises a conduit extending about an axis to define an axially extending cavity. The conduit includes an axially front section having an overlying wall and a rear section having an underlying wall. The overlying wall is configured to overlie the underlying wall of the forward chamber when the chambers are coupled together. The underlying wall is configured to underlie an overlying wall of the rearward chamber when said chambers are coupled together. A projection extends from the front section of the conduit. A pocket is located at the rear section of the conduit. The projection is configured to be received by the pocket of the front chamber, and the pocket is configured to receive the projection of the rear chamber. A notched structure extends radially inward from the front section and has a notch that is spaced from the front edge of the front section. The notched structure is configured to capture in the notch the underlying wall of the forward chamber when the chambers are coupled together.

22 Claims, 6 Drawing Sheets

COUPLING STRUCTURE FOR A LEACHING CHAMBER

TECHNICAL FIELD

The present invention relates to leaching chambers.

BACKGROUND

A leach field is used to disperse a fluid into the ground. The fluid is typically effluent from a septic tank. The leach field includes a series of leaching chambers, coupled in series and buried in the ground. A pipe conveys the effluent from the septic tank to the leach field, where the effluent spreads through the series of chambers that are oftentimes coupled end to end. Each chamber has perforated side walls and an open bottom through which the effluent escapes to be absorbed into the surrounding soil.

Each chamber must support the weight of the soil above it, along with anything resting on the soil, such as a vehicle. Therefore, the chamber walls are typically corrugated to increase weight bearing strength.

SUMMARY

Figure 1:
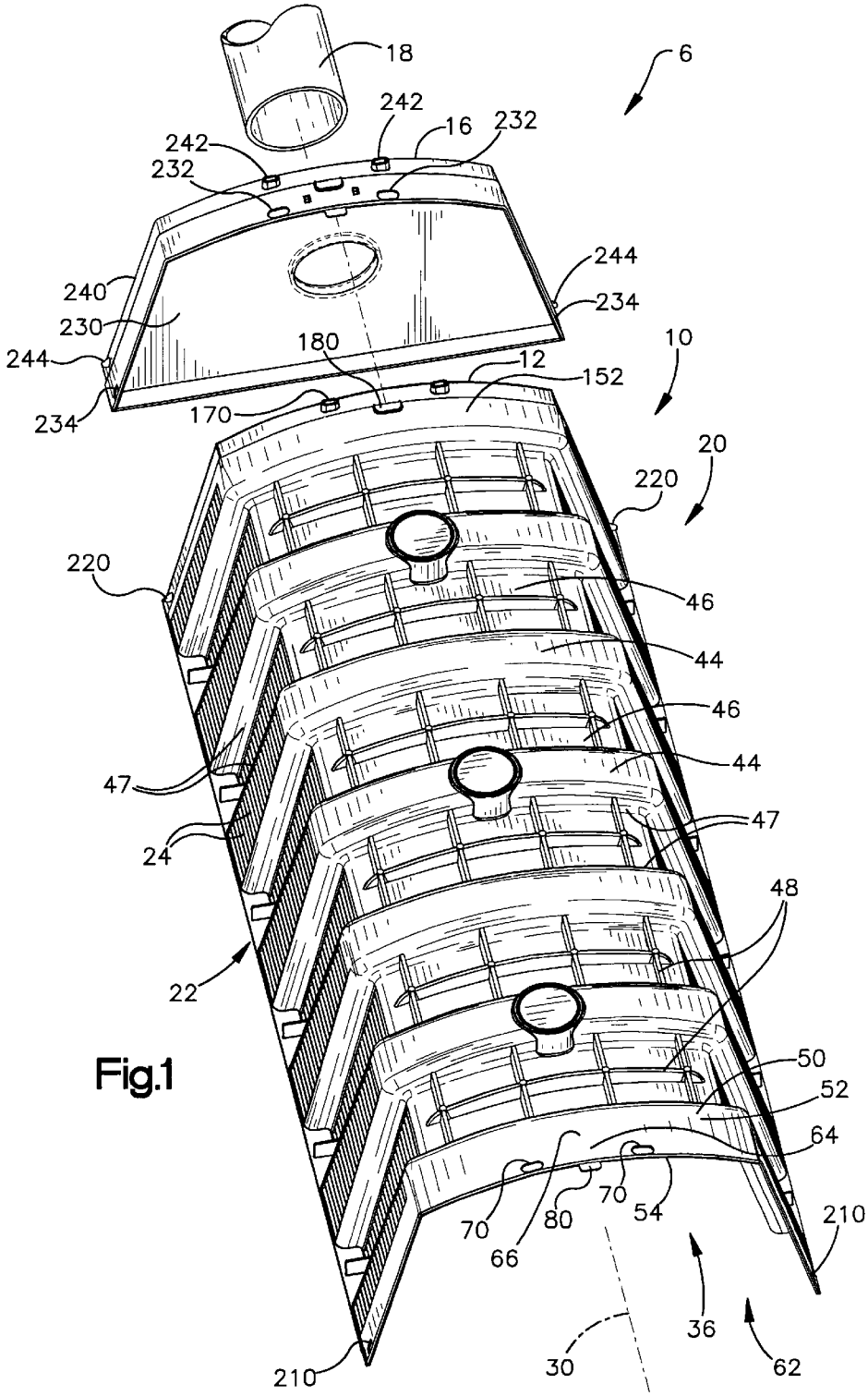
FIG. 1 is an exploded perspective view of a first leaching chamber according to the present invention.

An embodiment of the invention is a leaching chamber. The leaching chamber is configured to be coupled in series to another such leaching chamber located forward of the chamber and to yet another such leaching chamber located rearward of the leaching chamber. The leaching chamber comprises a conduit defining a cavity. The conduit includes a front section having an overlying wall and a rear section having an underlying wall. The overlying wall is configured to overlie the underlying wall of the forward chamber when the chambers are coupled together. The underlying wall is configured to underlie an overlying wall of the rearward chamber when said chambers are coupled together. A projection extends from the front section of the conduit. A pocket is located at the rear section of the conduit. The projection is configured to be received by the pocket of the front chamber, and the pocket is configured to receive the projection of the rear chamber. A notched structure defines a notch that is spaced from the front edge of the front section. The notched structure is configured to capture in the notch the underlying wall of the forward chamber when the chambers are coupled together.

Preferably, the pocket is configured to enable the projection of the forward chamber to pivot relative to the pocket when the projection is received by the pocket, so as to enable the forward chamber to pivot into and out of a coupled position. The notched structure is configured to enable the notch to swing into a position in which the notch captures the underlying wall of the forward chamber. The leaching chamber further comprises a hole in the overlying wall and a post extending radially outward from the underlying wall. The hole is configured to receive the post of the forward chamber when the chambers are coupled together. Correspondingly, the post is configured to be received by the hole of the rearward chamber when the chambers are coupled together.

Another embodiment comprises first and second chambers. The chambers include coupling structures that prevent the uncoupling of the chambers through translational movement of the chambers. Instead, the coupling structures enable the uncoupling to be achieved through a pivoting motion of the first chamber relative to the second chamber.

DESCRIPTION

The apparatus 6 shown in FIG. 1 has parts which, as described below, are examples of the elements recited in the claims.

The apparatus 6 comprises a first leaching chamber 10. The chamber 10 is used to disperse a fluid, such as effluent from a septic tank, into the ground. In its installed position, the chamber 10 is coupled in series with other such leaching chambers to form a leach field that is buried in the ground. The chambers may be positioned both end-to-end and side-to-side. An end 12 of the chamber 10 is capped with an end cap 16, which has an opening to receive the end of a pipe 18. The pipe 18 conveys the effluent from the septic tank to the leach field, where the effluent spreads through the series of chambers. The first chamber 10 comprises a first conduit 20 with an open bottom 22 and openings 24 through which the effluent escapes to be absorbed into the surrounding soil.

Figure 3:
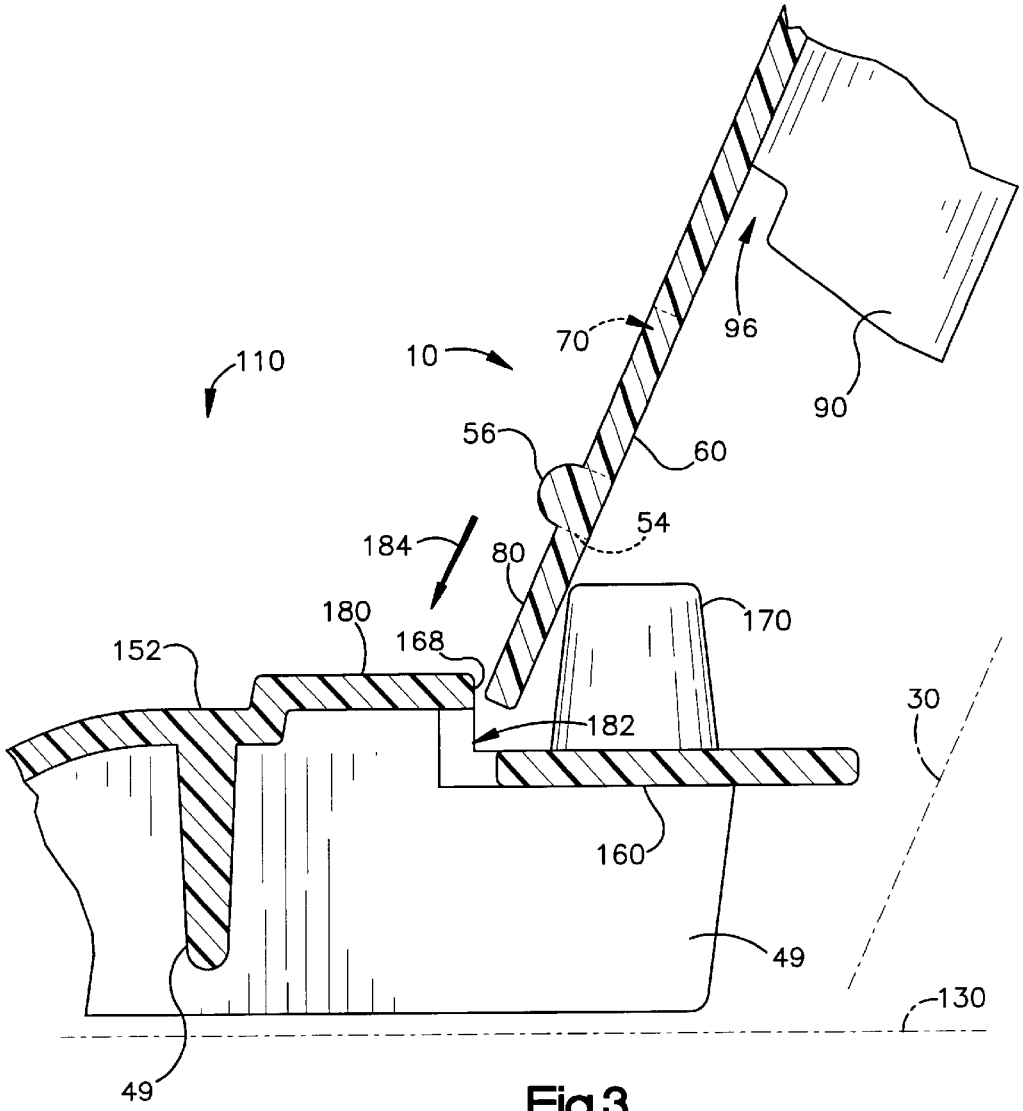
FIGS. 3–5 are sectional views of the leaching chambers of FIG. 2, shown sectioned along line 3—3 of FIG. 2 and in different orientations relative to each other, with the orientations corresponding to successive steps in a process of coupling the chambers together.

The first conduit 20 is an arched wall extending about a central axis 30 to define an axially extending cavity 36. The conduit 20 is corrugated in that it comprises an axially extending alternating series of perforated crowns 44 and valleys 46. The crowns 44 and valleys 46 are arched and separated from each other by radially-extending walls 47. The valleys 46 are reinforced with axially-extending and radially-extending external ribs 48. Correspondingly, the crowns 44 are reinforced with axially-extending and radially-extending internal ribs 49 (FIG. 3).

Figure 2:
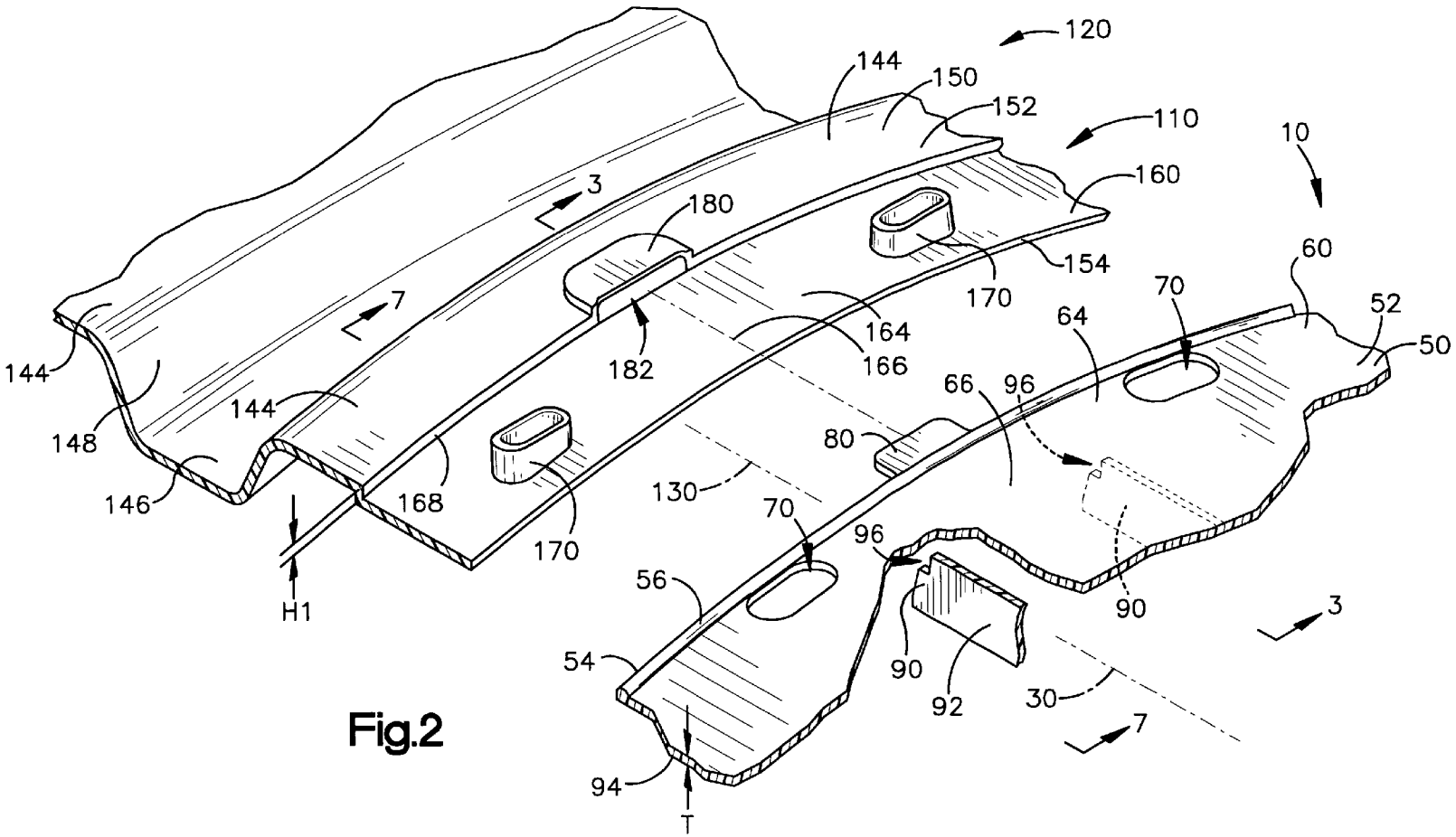
FIG. 2 is a perspective view of a portion of the first leaching chamber and of a second such leaching chamber.

As shown in FIG. 2 the frontmost crown 50 includes a front section 52. The front section 52 includes a front edge 54 defined by a bead 56. The front section 52 also includes an overlying wall 60 extending rearward from the front edge 54. The overlying wall 60 is arched, with an open bottom end 62 (FIG. 1) and an opposite top side 64 having a central peak 66.

Two holes 70 in the overlying wall 60 are located symmetrically about the central peak 66 at the top side 64 of the overlying wall 60. A projection 80, in this example a tongue, extends forward from and coplanar with the front section 52 at the central peak 66.

Two notched structures 90 extend radially inward from the front section 52, symmetrically spaced about the central peak 66. The notched structures are formed from axially-extending reinforcement ribs 92 that reinforce the overlying wall 60, and are extensions of ribs that reinforce the crowns 44. The notched structures 90, which include the bottom surface 94 of the overlying wall 60, define notches 96 that are spaced axially rearward from the front edge 54. In molding the chamber 10, formation of the notches 96 may be facilitated by incorporating holes in the front section 52 above the notches 90 to make room for a core.

A portion of a second leaching chamber 110 is also shown in FIG. 2. The second chamber 110 is like the first leaching chamber 10. Consequently, each feature described with reference to the second chamber 110 is also included on the first chamber 10. A portion like the portion of the second leaching chamber shown in FIG. 2 is positioned at the opposite end, the end not show of the first leaching chamber. Thus, each leaching chamber includes both a front section 150 and a rear section 152, as discussed in greater detail below.

The second chamber 110 includes a second conduit 120 extending about a central axis 130. Like the first conduit 20, the second conduit 120 is corrugated, with crowns 144 and valleys 146 separated by radially-extending walls 148.

The rearmost crown 150 of the second chamber 110 includes a rear section 152 with a rear edge 154. The rear section 152 includes an underlying wall 160 extending forward from the rear edge 154. The underlying wall 160 is configured to underlie the overlying wall 60 of the first chamber 10 when the chambers 10 and 110 are coupled together. Like the overlying wall 60, the underlying wall 160 is arched, with a top side 164 having a central peak 166. The underlying wall 160 is separated from the remainder of the rear section 152 by a rearward-facing shoulder 168. The radially-extending height HI of the shoulder 168 equals the wall thickness T of the overlying wall 60 of the first chamber 10.

Two posts 170 extend outwardly from the underlying wall 160 and are located symmetrically about the central peak 166 at the top side 164 of the overlying wall 160. The posts 170 are configured to be received by the holes 70 of the first chamber 10 when the chambers 10 and 110 are coupled together.

A pocket 180 is located at the rear section 152. The pocket 180 is configured to receive the projection 80 of the first leaching chamber 10 when the leaching chambers 10 and 110 are coupled together. The outside opening 182 of the pocket 180 is defined in the shoulder 168. The pocket 180 is raised slightly above the shoulder 168 on the crown 144. In addition, the pocket 180 has an open bottom, which is useful in joining the first chamber 10 to the second chamber 110, as discussed below.

Figure 4:
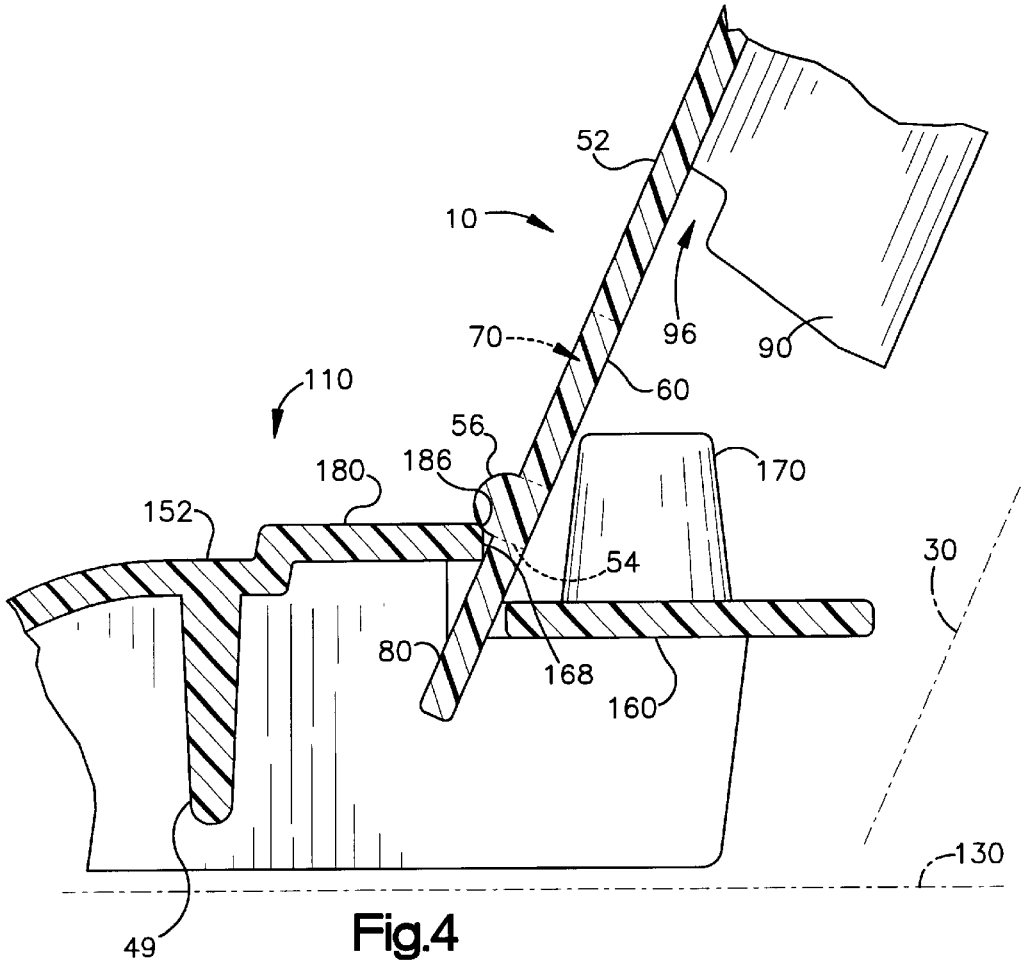

The first step in coupling the chambers 10 and 110 together is illustrated in FIG. 3. The second chamber 110 lies horizontally on the ground. The first chamber 10 is oriented such that the projection 80 is near and directed obliquely toward the pocket opening 182. Next, as shown by an arrow 184, the projection 80 is translationally moved toward and into the pocket 180. This continues until the front edge 54 abuts the shoulder 168, as shown in FIG. 4. The point of abutment on the shoulder 168 serves as a pivot point 186 in the following step.

Figure 5:
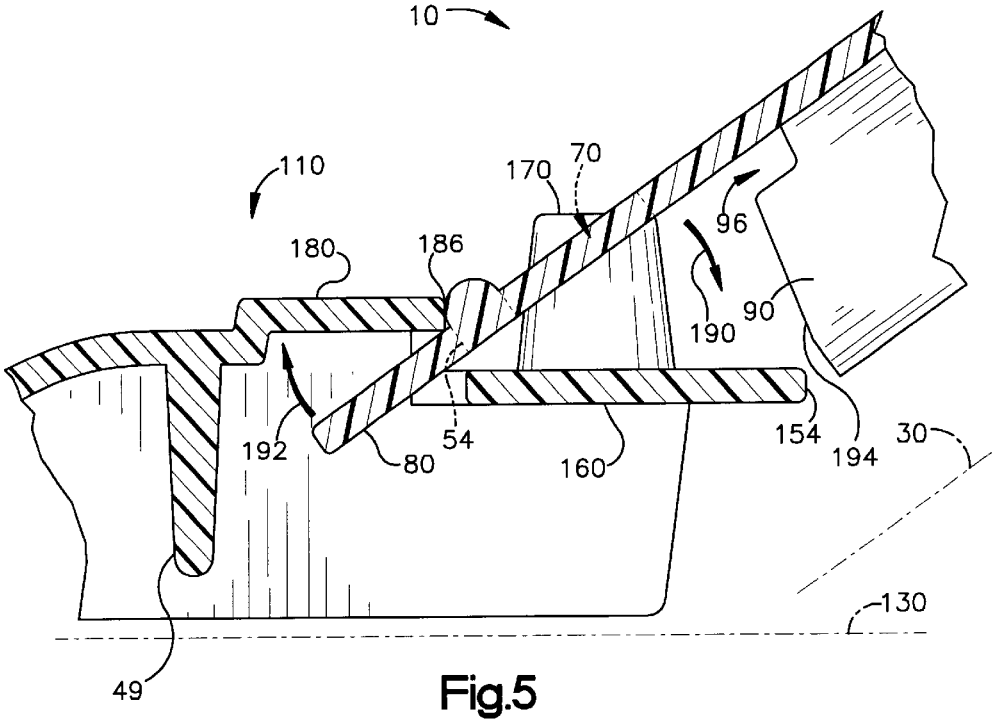

As indicated by arrow 190 in FIG. 5, the first chamber 10 is pivoted downward about the pivot point 186. Concurrently, the following things happen. The projection 80 pivots upward about the pivot point 186, as indicated by an arrow 192. The holes 70 move downward and receive the posts 170. Also, the notched structure 90 swings into a capturing position in which the underlying wall 160 is captured in the notch 96. As the notched structure 90 swings downward, the rear edge 154 of the underlying wall 160 rubs against and bends the front edge 194 of the notched structure 90 until the notched structure 90 snaps into the capturing position. In a preferred embodiment, edge 194 has a resiliency to allow it to substantially maintain its original shape after the underlying wall 160 is captured in notch 96.

Figure 6:
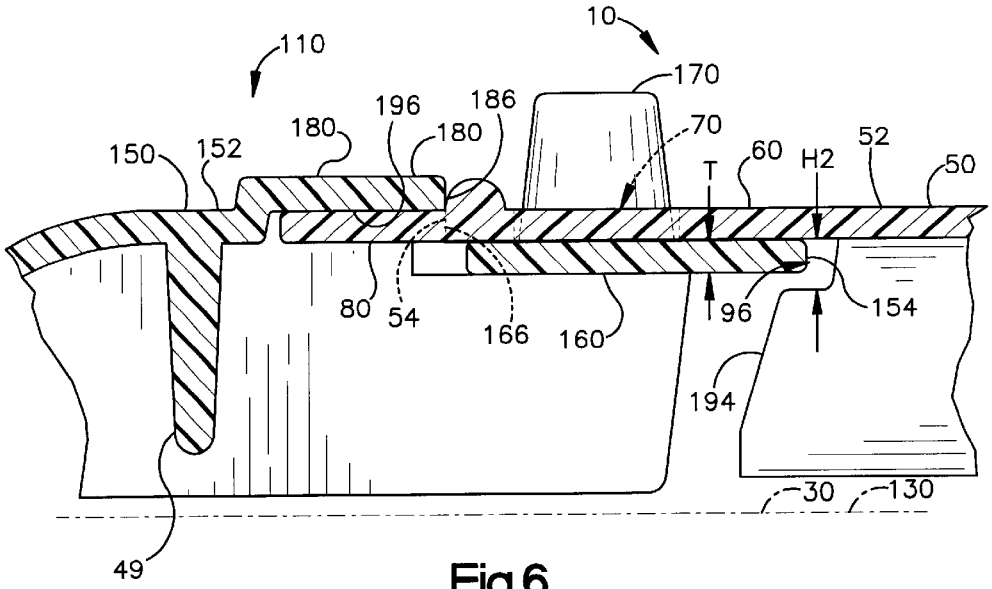
FIG. 6 is a sectional view of the leaching chambers, shown sectioned along line 3—3 of FIG. 2 and coupled together.

FIG. 6 shows the chambers 10 and 110 in a coupled position. In this position, translational movement (i.e., motion without rotation, for example purely axial or purely radial motion) of front section 52 the first chamber 10 relative to the rear section 152 of the second chamber 110 is limited, as follows. The posts 170 are captured in the holes 70. This limits axial movement of the front section 52 away from the rear section 152. Also, the underlying wall 160 is captured in the notch 96. This limits radially-inward and radially-outward translational movement of the underlying wall 160 relative to the overlying wall 60. Radially-outward movement of the underlying wall 160 is also limited by abutment of the projection 80 against the top wall 196 of the pocket 180. Different modes of movement are also limited or deterred in other ways as evident to those of skill in the art. In each description above of limiting translational movement, the extent of movement that can occur is a function of the clearance, if any, between abutting structures and the flexibility of those structures.

Consequently, the posts 170 captured in the holes 70, the projection 80 captured in the pocket 180, and the underlying wall 160 captured in the notched structure 90 all deter uncoupling of the front and rear sections 52 and 152 through translational movement. However, these structures enable pivotal movement of the front and rear sections 52 and 152. For example, although the pocket 180 has the upper wall 196 that limits radially outward movement of the projection 80, the pocket 180 lacks a lower wall or other structure that would prevent downward pivoting of the projection 80 within the pocket 180.

In fact, the posts 170 and holes 70 in combination with the projection 80 and pocket 180 not only enable, but require the coupling and uncoupling to be achieved through a pivoting motion of the first chamber 10 relative to the second chamber 110 because the projection 80 is spaced forward the posts 170. At the beginning of the coupling process, depicted in FIG. 3, the projection 80 is directed downwardly into the pocket opening 182 while the overlying wall 60 remains sufficiently tilted upwardly and raised to clear the post 170. The inward movement ends when the front edge 54 abuts the shoulder 168. At that point, the hole 70 slips over the post 170 to allow the overlying section 60 to pivot downwardly. Similarly, in the uncoupling process, with the axially-extending projection 80 vertically captured in the opening 182, the first chamber 10 is pivoted upwardly to raise the overlying wall 60 sufficiently to clear the post 170.

As shown in FIG. 6, the height H2 of the notch 96 is greater than the thickness T of the underlying wall 160 captured by the notch 96. Furthermore, the notch 96 is axially spaced from the front edge 54. These factors enable the notch structure 90 to swing into the capturing position without being blocked by the underlying wall 160. The swinging movement is hindered, but not prevented, by the rear edge 154 of the underlying wall 152 rubbing against the front edge 194 of the notched structure 90, because the notched structure 90 bends to accommodate the swinging movement.

Figure 7:
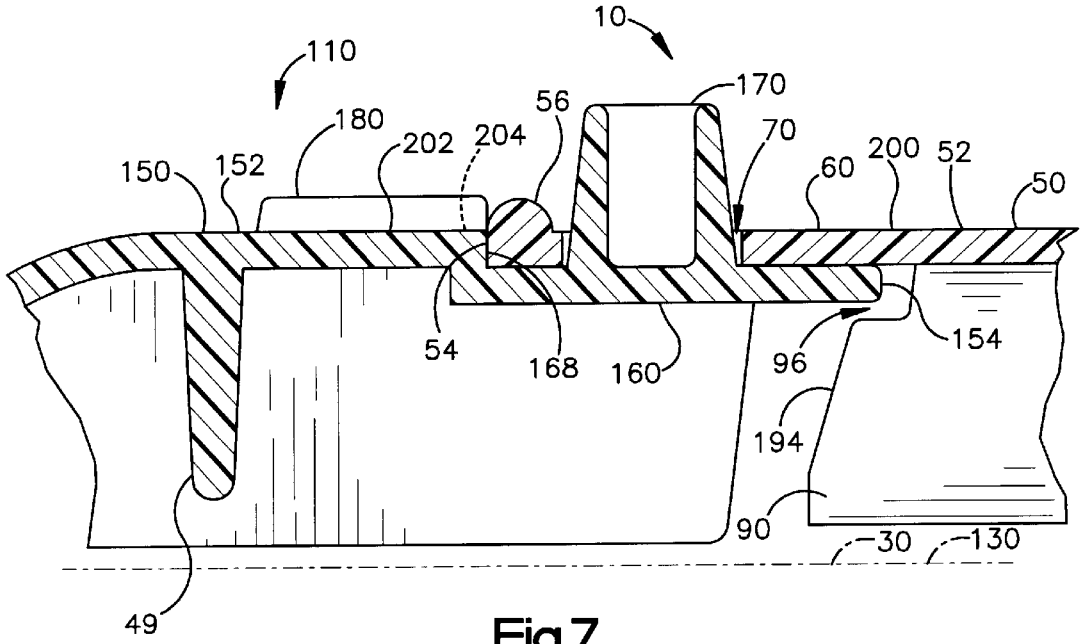
FIG. 7 is a view similar to FIG. 6, with the leaching chambers shown sectioned along line 7—7 of FIG. 2.

As mentioned above, the height H1 (FIG. 2) of the shoulder 168 equals the wall thickness T of the overlying wall 60. Consequently, as illustrated in FIG. 7, when the chambers 10 and 110 are coupled together, the top surfaces 200 and 202 of the front and rear sections 52 and 152 follow a single smooth curve interrupted only by the bead 56, projections 170, and pocket 180.

In the above described embodiment, as shown in FIG. 2, each of the overlying and underlying walls 60 and 160 has a hole and a projection, to respectively mate with a corresponding projection and hole of the other wall. Specifically, the overlying wall 60 has the hole 70 and the axially-extending projection 80. The underlying wall 160 also has a hole, referred to the pocket opening 182, and a radially-extending projection, referred to as the post 170.

However, in an alternative embodiment, both the axially-extending and radially-extending projections 80 and 170 can extend from the overlying wall 60, and both holes 70 and 182 can be in or adjacent the underlying wall 160. In such an embodiment, the radially-extending post 170 extends downward from the overlying wall 60, instead of upward from the underlying wall 160 as shown in FIG. 2. Other positions may also be utilized for the posts 170 and holes 70.

As shown in FIG. 1, the first chamber 10 has two lower holes 210 and two corresponding lower posts 220, that are similar to the upper holes 70 and upper posts 170 described above. In the process of coupling the chambers 10 and 110 together, as the first conduit 20 is pivoted downward, its side walls are bent slightly to enable the lower holes 210 of the first chamber 10 to receive the lower posts 220 of the second chamber 110. These holes 210 and posts 220 can be positioned on either end of the chamber in a number of different positions.

Referring to FIG. 1, the end cap 16 has, at its front side 230, upper and lower holes 232 and 234 configured to receive the upper and lower posts 170 and 220 when the end cap 16 is coupled to the rear section 152 of the chamber 10. The end cap 16 also has, at its rear side 240, upper and lower posts 242 and 244 configured to be received by the upper and lower holes 70 and 210 when the end cap 16 is coupled to the front section 52 of another chamber 10.

Although the chambers 10 and 110 in this example are made of polyethylene, the invention applies to any suitable material. Similarly, the invention applies to a chamber of any suitable shape and size. Also, although one projection 80, two posts 170 and two notched structures 90 are shown in the example, different numbers of each structure and different suitable locations for each structure are possible.

While various features of the claimed invention are presented above, it should be understood that the features may be used singly or in any combination thereof. Therefore, the claimed invention is not to be limited to only the specific embodiments depicted herein.

This written description uses examples to disclose the invention, including the best mode, and also to enable any person skilled in the art to make and use the invention. The patentable scope of the invention is defined by the claims, and may include other examples that occur to those skilled in the art. Such other examples are intended to be within the scope of the claims if they have elements that do not differ from the literal language of the claims, or if they include equivalent structural elements with insubstantial differences from the literal language of the claims.

What is claimed is:

1. A leaching chamber configured to be coupled in series to another like leaching chamber located forward of said chamber and to yet another like leaching chamber located rearward of said leaching chamber, said leaching chamber comprising:

a conduit defining a cavity, said conduit including a front section having an overlying wall and a rear section having an underlying wall, said overlying wall being configured to overlie the underlying wall of a like forward chamber when said chambers are coupled together, and said underlying wall being configured to underlie an overlying wall of a like rearward chamber when said chambers are coupled together;

a projection extending from said front section of said conduit;

a pocket formed in said rear section of said conduit, said projection being configured to be received by a like pocket of a like forward chamber and said pocket being configured to receive a like projection of a like rearward chamber; and a notched structure defining a notch that is spaced from a front edge of said front section, said notched structure being configured to capture in said notch the underlying wall of a like forward chamber when said chambers are coupled together.

2. The leaching chamber of claim 1 wherein said overlying wall has an arched cross-section, with an open bottom end and an opposite top end, said projection being located at said top end, and said conduit is a corrugated structure comprising an axially extending alternating series of crowns and valleys separated from each other by radially-extending walls, the frontmost crown including said front section.

3. The leaching chamber of claim 1 wherein said pocket is configured to enable a projection of a like rearward chamber to pivot relative to said pocket when said projection is received by said pocket such that the like rearward chamber can pivot downward into and upward out of a coupled position with said chamber.

4. The leaching chamber of claim 1 wherein said projection extends forward from said front section and said pocket has a radially outer wall that limits radially outward movement of a projection of a like chamber when the projection is received by said pocket, and said pocket lacks a radially inner wall that would prevent pivoting of the projection in the pocket.

5. The leaching chamber of claim 1 wherein said notched structure is configured to enable said notch to swing into a position in which said notch captures the underlying wall of a like forward chamber.

6. The leaching chamber of claim 1 wherein said notched structure is part of an axially-extending reinforcement rib that reinforces said overlying wall.

7. The leaching chamber of claim 1 further comprising a hole defined in said overlying wall and a post extending radially outward from said underlying wall, said hole being configured to receive a post of a like forward chamber when said chambers are coupled together, and said post being configured to be received by a hole of a like rearward chamber when said chambers are coupled together.

8. The leaching chamber of claim 1 wherein said rear section includes a rearward-facing shoulder bordering said underlying wall, and the radially-extending height of said shoulder equals the wall thickness of the overlying wall.

9. A leaching chamber configured to be coupled in series to another leaching chamber, said leaching chamber comprising:

a conduit extending about an axis to define an axially extending cavity, said conduit having a rear section and a front section, the rear section being configured to be coupled at said rear section to another leaching chamber, said rear section having a rearward-facing shoulder; and a pocket comprising an opening in said shoulder and configured to receive a projection of another leaching chamber when said leaching chamber is coupled to the other leaching chamber.

10. The leaching chamber of claim 9 wherein the radially-extending height of said shoulder equals a wall thickness of said front section.

11. The leaching chamber of claim 9 wherein said pocket has a radially outer wall that limits radially outward movement of the projection when a projection is received by said pocket, and lacks a radially inner wall that would prevent radially inward pivoting of a projection.

12. A leaching chamber configured to be coupled in series to another such leaching chamber located forward of said chamber and yet another such leaching chamber located rearward of said leaching chamber comprising:

a conduit extending about an axis to define an axially extending cavity, said conduit including a front section having a front edge and an overlying wall and a rear section having an underlying wall, said overlying wall being configured to overlie the underlying wall of a forward chamber when said chambers are coupled together, and said underlying wall being configured to underlie an overlying wall of a rearward chamber when said chambers are coupled together; and a notched structure extending radially inward from said front section, said notched structure having a notch axially spaced from the front edge of said front section, and said notched structure being configured to capture in said notch, in a capturing position, the underlying wall of the forward chamber when said chambers are coupled together to limit radially-inward and radially-outward translational movement of the underlying wall relative to said overlying wall of said chamber, said notched structure being configured to pivotally swing into said capturing position.

13. The leaching chamber of claim 12 wherein said notched structure is part of an axially-extending reinforcement rib that reinforces said overlying wall.

14. A set of leaching chambers comprising:

a first leaching chamber comprising a first conduit extending about a first axis to define a first cavity, said first conduit having a front section and a rear section, said front section including an overlying wall; and a second leaching chamber comprising a second conduit extending about a second axis to define a second cavity, said second conduit having a front section and a rear section and being configured to be coupled at said rear section to the front section of the first leaching chamber; said first and second chambers including coupling structures at the front and rear sections that deter the uncoupling of said chambers solely through translational movement of said chambers, and enable and require the uncoupling to be achieved through a pivoting motion of said first chamber relative to said second chamber;

said coupling structures including a projection extending axially from said front section and a pocket defined at said rear section, said projection of the first chamber being configured to be received by said pocket of said second chamber, thereby preventing radial movement of said first chamber away from said second chamber when coupled; and said coupling structures further including a post extending radially from one of said front and rear sections and a hole in the other of said front and rear sections, said post being configured to be received by said hole when said first and second chambers are coupled together, thereby limiting axial movement of said first chanber away from said second chamber.

15. A method of coupling a first leaching chamber to a second leaching chamber lying horizontally on the ground, said first and second chambers extending about respective first and second axes to define respective first and second axially extending cavities, said method comprising:

providing a set of leaching chambers according to claim 14;

orienting said first chamber such that the projection of said first chamber is directed obliquely downward toward the pocket in said second chamber, and said first axis is directed obliquely upward away from said second chamber;

translationally moving said projection axially toward and into said pocket of said second leaching chamber until an edge of said first chamber abuts a shoulder of said second chamber, thereby defining a point of abutment; and pivoting said first chamber downward about said point of abutment until the first and second axes coincide and such that, during said pivoting, the hole in one of the chambers receives the post of the other chamber.

16. The method of claim 15 wherein, during said pivoting, a notched structure defined on the first chamber swings into a position in which a notch of the notched structure captures a wall of the second chamber.

17. A leaching chamber configured to be coupled in series to another such leaching chamber located forward of said chamber and yet another such leaching chamber located rearward of said leaching chamber, said leaching chamber comprising:

a conduit extending about an axis to define an axially extending cavity, said conduit including a front section having a front edge and an overlying wall and a rear section having an underlying wall, said overlying wall being configured to overlie the underlying wall of a forward chamber when said chambers are coupled together, and said underlying wall being configured to underlie an overlying wall of a rearward chamber when said chambers are coupled together;

a notched structure extending radially inward from said front section, said notched structure having a notch axially spaced from the front edge of said front section, and said notched structure being configured to capture in said notch, in a capturing position, the underlying wall of the forward chamber when said chambers are coupled together to limit radially-inward and radially-outward translational movement of the underlying wall relative to said overlying wall of said chamber, said notched structure being configured to pivotally swing into said capturing position; and at least one post extending radially outward from the underlying wall and at least one hole defined in the overlying wall, said post and hole being axially aligned and said hole being shaped and sized to receive the post.

18. A leaching chamber configured to be coupled in series to a like leaching chamber having a projection, said leaching chamber comprising:

a conduit extending about an axis to define an axially extending cavity, said conduit having a rear section and being configured to be coupled at said rear section to a like leaching chamber; and a pocket located at said rear section and configured to receive a projection of the like leaching chamber when said leaching chamber is coupled to the like chamber;

said pocket being configured to enable the projection of the like leaching chamber to pivot relative to said pocket when the projection of the like chamber is received by said pocket such that the like chamber can pivot downward into and upward out of a coupled position with said chamber; and the projection that said pocket is configured to receive extends axially forward from the like chamber, and said pocket has a radially outer wall that limits radially outward movement of the projection when the when the projection is received by said pocket, and lacks a radially inner wall that would prevent pivoting of the projection.

19. A leaching chamber configured to be coupled in series to a like leaching chamber having a projection, said leaching chamber comprising:

a conduit extending about an axis to define an axially extending cavity, said conduit having a rear section and being configured to be coupled at said rear section to a like leaching chamber; and a pocket located at said rear section and configured to receive a projection of the like leaching chamber when said leaching chamber is coupled to the like chamber;

said pocket being configured to enable the projection of the like leaching chamber to pivot relative to said pocket when the projection of the like chamber is received by said pocket such that the like chamber can pivot downward into and upward out of a coupled position with said chamber; and said rear section includes an underlying wall configured to underlie an overlying wall of a like leaching chamber when said leaching chamber is coupled to the like leaching chamber.

20. The leaching chamber of claim 19 further comprising a post extending radially outward from said underlying wall and configured to be received by a hole in an overlying wall of a like leaching chamber when said leaching chambers are coupled together.

21. A set of leaching chambers comprising:

a first leaching chamber comprising a first conduit extending about a first axis to define a first cavity, said first conduit having a front section; and a second leaching chamber comprising a second conduit extending about a second axis to define a second cavity, said second conduit having a rear section and being configured to be coupled at said rear section to the front section of the first leaching chamber;

said first and second chambers including coupling structures at the front and rear sections that deter the uncoupling of said chambers solely through translational movement of said chambers, and enable and require the uncoupling to be achieved through a pivoting motion of said first chamber relative to said second chamber; and said coupling structures include a projection extending forward from said front section and a pocket defined in said rear section, said pocket being configured to receive said projection when said chambers are coupled together, said pocket having a radially outer wall that limits radially outward movement of said projection when said projection is received by said pocket, and said pocket lacking a radially inner wall that would prevent radially-inward pivoting of said projection.

22. A set of leaching chambers comprising:

a first leaching chamber comprising a first conduit extending about a first axis to define a first cavity, said first conduit having a front section; and a second leaching chamber comprising a second conduit extending about a second axis to define a second cavity, said second conduit having a rear section and being configured to be coupled at said rear section to the front section of the first leaching chamber;

said first and second chambers including coupling structures at the front and rear sections that deter the uncoupling of said chambers solely through translational movement of said chambers, and enable and require the uncoupling to be achieved through a pivoting motion of said first chamber relative to said second chamber; and said coupling structures include a notched structure extending radially inward from said front section and defining a notch that is axially spaced from a front edge of said front section, said notched structure being configured to capture in said notch, in a capturing position, a portion of said rear section when said chambers are coupled together to limit radially-inward and radially-outward translational movement of said rear section relative to said front section, and said notched structure being further configured to allow pivotal movement of said front section into said capturing position.

* * * * *

UNITED STATES PATENT AND TRADEMARK OFFICE

CERTIFICATE OF CORRECTION

PATENT NO. : 6,698,975 B1
DATED : March 2, 2004
INVENTOR(S) : Benecke

It is certified that error appears in the above-identified patent and that said Letters Patent is hereby corrected as shown below:

Column 9,
Line 7, delete the second instance of the words “when the”.

Signed and Sealed this

Fifteenth Day of June, 2004

JON W. DUDAS
*Acting Director of the United States Patent and Trademark Office*